US009501917B2

(12) United States Patent
Slim

(10) Patent No.: US 9,501,917 B2
(45) Date of Patent: Nov. 22, 2016

(54) THEFT DETERRENT DEVICE, SYSTEM, AND METHOD

(71) Applicant: Sami Slim, Coral Springs, FL (US)

(72) Inventor: Sami Slim, Coral Springs, FL (US)

( * ) Notice: Subject to any disclaimer, the term of this patent is extended or adjusted under 35 U.S.C. 154(b) by 115 days.

(21) Appl. No.: 14/580,299

(22) Filed: Dec. 23, 2014

(65) Prior Publication Data

US 2016/0180676 A1 Jun. 23, 2016

(51) Int. Cl.

| | |
|---|---|
| ***G08B 13/00*** | (2006.01) |
| ***G08B 13/24*** | (2006.01) |
| ***G08B 21/22*** | (2006.01) |
| ***G08B 29/04*** | (2006.01) |

(52) U.S. Cl.

CPC ..... *G08B 13/2491* (2013.01); *G08B 13/2494* (2013.01); *G08B 21/22* (2013.01); *G08B 29/046* (2013.01)

(58) Field of Classification Search

CPC . G08B 21/22; G08B 21/0261; G06F 21/554; G06F 21/88

USPC ..... 340/541, 539.23, 573.4, 5.31

See application file for complete search history.

(56) References Cited

U.S. PATENT DOCUMENTS

| | | | | |
|---|---|---|---|---|
| 5,608,382 | A * | 3/1997 | Webb | A61B 90/90 340/5.81 |
| 6,563,423 | B2 | 5/2003 | Smith | |
| 7,076,441 | B2 | 7/2006 | Hind et al. | |
| 7,098,795 | B2 | 8/2006 | Adamczyk et al. | |
| 7,123,146 | B1 | 10/2006 | Holzman | |
| 7,142,119 | B2 | 11/2006 | Siefke et al. | |
| 7,164,354 | B1 | 1/2007 | Panzar | |
| 7,187,287 | B2 | 3/2007 | Ryal | |
| 7,327,251 | B2 | 2/2008 | Corbett, Jr. | |
| 7,411,497 | B2 | 8/2008 | Kates | |
| 8,682,356 | B2 | 3/2014 | Poe et al. | |
| 2004/0189471 | A1 | 9/2004 | Ciarcia, Jr. et al. | |
| 2006/0152374 | A1 | 7/2006 | Singer et al. | |
| 2006/0202832 | A1 | 9/2006 | Reznik et al. | |
| 2008/0291011 | A1 | 11/2008 | Knight | |
| 2008/0316023 | A1* | 12/2008 | Crowl | G08B 21/22 340/539.13 |
| 2009/0021398 | A1 | 1/2009 | Thompson | |
| 2011/0043362 | A1 | 2/2011 | Reibel | |
| 2012/0320199 | A1* | 12/2012 | Kundu | G06Q 20/202 348/143 |
| 2012/0320214 | A1 | 12/2012 | Kundu et al. | |
| 2012/0321146 | A1 | 12/2012 | Kundo et al. | |
| 2013/0207803 | A1 | 8/2013 | Charych | |
| 2014/0179342 | A1 | 6/2014 | Hamerly | |

FOREIGN PATENT DOCUMENTS

| | | | |
|---|---|---|---|
| JP | 2005128701 | A | 5/2005 |

* cited by examiner

*Primary Examiner* — Toan N Pham

(74) *Attorney, Agent, or Firm* — The Concept Law Group, P.A.; Scott D. Smiley; Yongae Jun

(57) ABSTRACT

A monitoring system is disclosed for monitoring and deterring entrance of supervised individuals into an area. The system includes a wearable monitoring device configured to be worn by an individual to be deterred from entrance into a retail environment. The wearable monitoring device includes a theft deterrent device operably configured to be detectable by at least one theft deterrent gate device disposed proximate an entrance area to a retail environment; and an alarm operably configured to communicate an alarm condition in response to the theft deterrent gate device detecting the theft deterrent device.

22 Claims, 12 Drawing Sheets

100

102

300

104

800

1100

1200

THEFT DETERRENT DEVICE, SYSTEM, AND METHOD

FIELD OF THE INVENTION

The present invention relates generally to theft deterrent technology, and more particularly relates to wearable electronic monitoring devices.

BACKGROUND OF THE INVENTION

It is well-known that retailers and business owners can suffer substantial financial losses as a result of retail theft. In many cases, shoplifters and thieves are repeat offenders. To protect against such losses, retailers and store owners have installed various theft deterrent systems, such as video systems, security personnel, and electronic article surveillance (EAS) systems.

Video systems are very expensive to acquire, install, and maintain. Video systems also require the store owners to hire personnel to view and monitor the video. Security personnel placed at retail entrances are limited because the security personnel are usually not able to visually discern whether an individual is leaving the retail environment with a purchased or a stolen item. EAS systems are used to identify articles as they pass through a gated area in a store. All articles must be tagged in order for the gate to identify that there has been an unauthorized removal of the article. Tagging all items within a retail store can be very costly, particularly if the tags are designed to remain on the packaging, even after purchase, and therefore cannot be reused. None of these current systems are particularly designed to address the problem of repeat shoplifting offenders. The National Association for Shoplifting Prevention (NASP) conducted a study in 2011 including data gathered from 15,000 shoplifting offenders. The NASP study showed that nearly half of the shoplifting offenders admitted to being repeat offenders.

Therefore, a need exists to overcome the problems with the prior art as discussed above.

SUMMARY OF THE INVENTION

The invention provides a theft deterrent device, system, and method that overcomes the hereinafore-mentioned disadvantages of the heretofore-known devices and methods of this general type.

With the foregoing and other objects in view, there is provided, in accordance with the invention, a wearable electronic monitoring device for deterring and/or monitoring entrance of an individual wearing the device into an area, the device including a wearable body configured to be worn by an individual to be deterred from entrance into a retail environment; a theft deterrent device coupled to the wearable body and operably configured to be detectable by at least one theft deterrent gate device disposed proximate an entrance area to the retail environment; and an alarm coupled to the wearable body and operably configured to communicate an alarm condition in response to the at least one theft deterrent gate device detecting the theft deterrent device.

In accordance with another feature, an embodiment of the present invention includes memory storing an identification associated with the individual to be deterred from entrance into the retail environment.

In accordance with a further feature of the present invention, an embodiment includes a controller having a processor and memory; and program instructions stored in memory and executable by the processor to perform the step of communicating a monitored retail environment entry attempt.

In accordance with a further feature of the present invention, an embodiment includes a speaker operably configured to communicate an audio alarm condition in response to the at least one theft deterrent gate device detecting the theft deterrent device.

In accordance with another feature of the present invention, the at least one theft deterrent gate device includes a transmitter gate operably configured to transmit a first signal; and a receiver gate operably configured to receive the first signal from the transmitter gate and operably configured to detect a variation of the first signal indicative of the theft deterrent device being within range of the receiver gate, the variation including at least one of: an interference with the first signal; a decrease in a strength of the first signal; and a second signal transmitted by the theft deterrent device between periodic, discontinuous pulses of the first signal.

In accordance with another feature of the present invention, the theft deterrent device is formed as at least one of a radio frequency tag; an electromagnetic tag; and an acousto-magnetic tag.

In accordance with yet another feature of the present invention, the wearable body is formed as at least one of an anklet; and a bracelet.

In accordance with yet another feature, an embodiment of the present invention includes a monitoring system for deterring entrance of supervised individuals from entering into an area, the system including a wearable monitoring device configured to be worn by an individual to be deterred from entrance into a retail environment, the wearable monitoring device including a theft deterrent device operably configured to be detectable by at least one theft deterrent gate device disposed proximate an entrance area to a retail environment; and an alarm operably configured to communicate an alarm condition in response to the at least one theft deterrent gate device detecting the theft deterrent device.

In accordance with a further feature of the present invention, an embodiment includes a wearable anti-tamper device configuring to be worn by the individual and communicatively coupled to the wearable monitoring device, the wearable anti-tamper device including a controller having a processor and memory; and program instructions stored in memory and executable by the processor to perform the steps of communicating a first anti-tamper ping signal to the wearable monitoring device; receiving a second anti-tamper ping signal from the wearable monitoring device; determining whether the second anti-tamper ping signal is received in response to the first anti-tamper ping signal within a predetermined time period; and causing an anti-tamper alarm to communicate a tamper alarm condition in response to determining that the second anti-tamper ping signal was not received within the predetermined time period.

In accordance with yet another feature, an embodiment of the present invention includes a wearable anti-tamper device configuring to be worn by the individual and communicatively coupled to the wearable monitoring device, the wearable anti-tamper device including a controller having a processor and memory, the memory storing a predetermined time period; at least one antenna communicatively coupled to the controller; an anti-tamper alarm communicatively coupled to the controller; and program instructions stored in memory. The programming instruction are executable by the processor to perform the steps of communicating a first anti-tamper ping signal to the wearable monitoring device via the at least one antenna; receiving a second anti-tamper ping signal from the wearable monitoring device via the at least one antenna; determining whether the second anti-tamper ping signal is received in response to the first anti-tamper ping signal within the predetermined time period; and causing the anti-tamper alarm to communicate a tamper alarm condition in response to determining that the second anti-tamper ping signal was not received within the predetermined time period.

In accordance with another feature, an embodiment of the present invention includes memory including a plurality of identifications associated with individuals to be deterred from entrance into the retail environment; and a processor communicatively coupled to the at least one theft deterrent gate device disposed proximate the entrance area to the retail environment, the processor operably configured to execute program instructions stored in memory. The program instructions include instructions for receiving a communication of an identification associated with the individual to be deterred from entrance into the retail environment; determining whether the identification corresponds to one of the plurality of identifications stored in the memory; and in response to the identification corresponding to one of the plurality of identifications stored in memory, causing an alarm condition.

In accordance with a further feature of the present invention, the alarm condition includes at least one of generating an audible alarm; communicating a monitored retail environment entry attempt to store personnel; and communicating a monitored retail environment entry attempt to an officer.

In accordance with yet another feature, an embodiment of the present invention includes a method for deterring entrance of supervised individuals from entering into an area, the method including providing a wearable monitoring device associated with an individual to be deterred from entrance into a retail environment, the device including a theft deterrent device, the theft deterrent device operably configured to be detectable by at least one theft deterrent gate device disposed proximate an entrance area to the retail environment; and an audible alarm. The method further includes, in response to the at least one theft deterrent gate device detecting the theft deterrent device, causing the audible alarm to sound.

In accordance with another aspect, an embodiment of the present invention includes providing a wearable anti-tamper device communicatively coupled to the wearable monitoring device; the wearable anti-tamper device communicating a first anti-tamper ping signal to the wearable monitoring device; the wearable monitoring device communicating a second anti-tamper ping signal to the wearable anti-tamper device; determining a time period between the first anti-tamper ping signal and the second anti-tamper ping signal; and communicating an anti-tamper alarm condition in response to the time period reaching or exceeding a predetermined time period.

In yet another aspect, an embodiment of the present invention includes storing in memory an identification associated with the individual to be deterred from entrance into the retail environment.

Although the invention is illustrated and described herein as embodied in a theft deterrent device, system, and method, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the first wearable electronic monitoring device. The terms "program," "software application," "program instructions," and the like as used herein, are defined as a sequence of instructions designed for execution on a computer system. A "program," "computer program," "program instructions," or "software application" may include a subroutine, a function, a procedure, an object method, an object implementation, an executable application, an applet, a servlet, a source code, an object code, a shared library/dynamic load library and/or other sequence of instructions designed for execution on a computer system.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
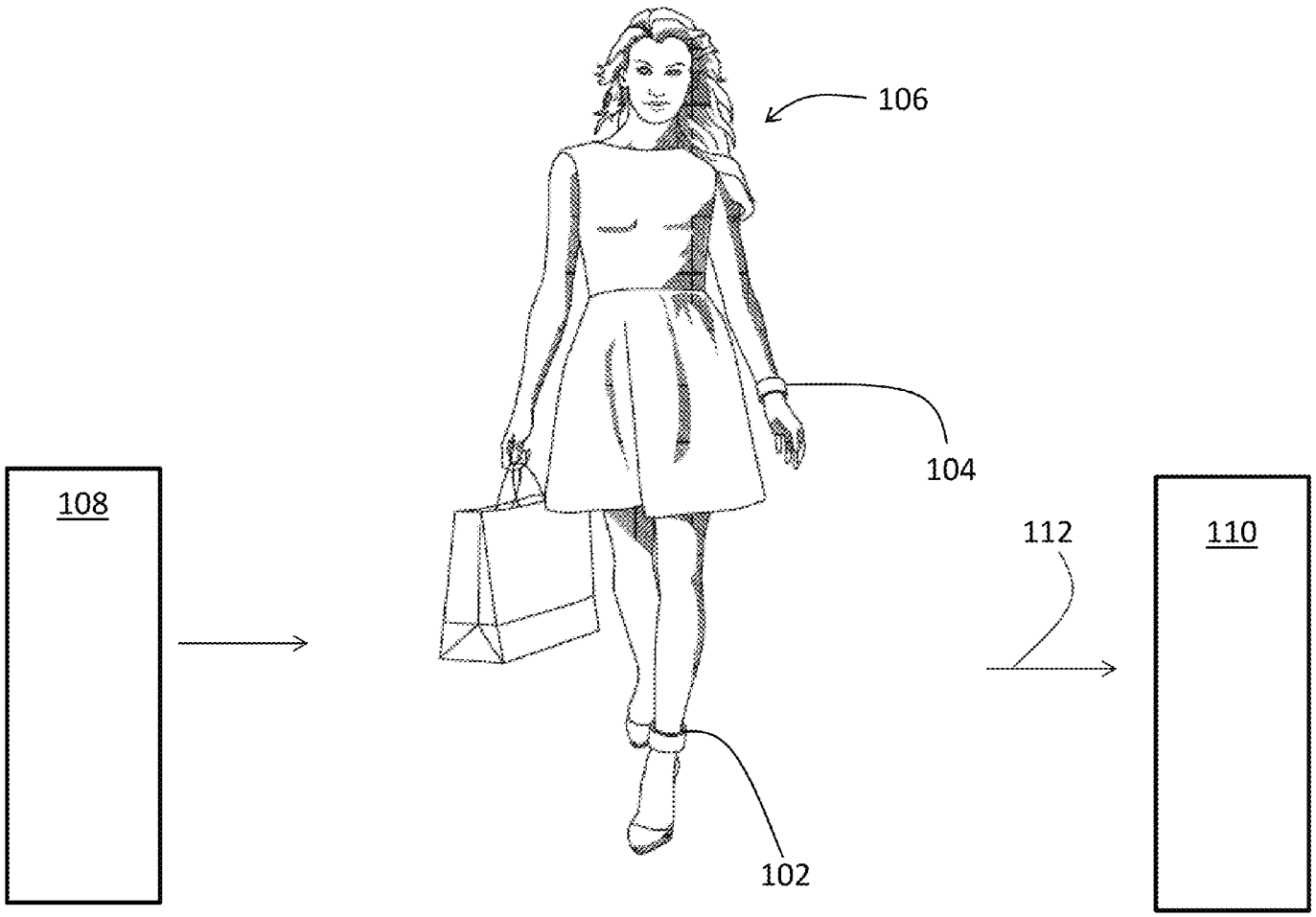
FIG. 1 is a schematic diagram of a theft deterrent system having an anklet and a bracelet, in use at a retail location with security gates, in accordance with an embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient system and method for deterring repeat offender shoplifters (and/or supervised offenders who may be first time offenders) from entering monitored retail environments by sounding an audible alarm and/or alerting the retail store of entrance and exit attempts of repeat offenders so that, for example, retail personnel can more closely monitor repeat offenders' or supervised offenders' activities. Embodiments of the invention provide for court systems to require certain convicted repeat offenders to wear a theft deterrent anklet configured to communicate with current, pre-existing EAS gate systems (and/or a separate alarm detection system) to sound the audible alarm when the gate detects the theft deterrent anklets. In addition, embodiments of the invention provide that the theft deterrent anklets continue to sound off the audible alarm until the shoplifter's probation officer or other official deactivates the alarm or, alternatively, until the audible alarm automatically times out. In some embodiments, the anklet is paired with another wearable device, such as a bracelet, that operates as an anti-tamper device by sending a ping signal to the anklet and requiring the anklet to respond with a response ping signal within a predetermined time period. In embodiments, failure to do so will result in an alarm condition.

Figure 2:
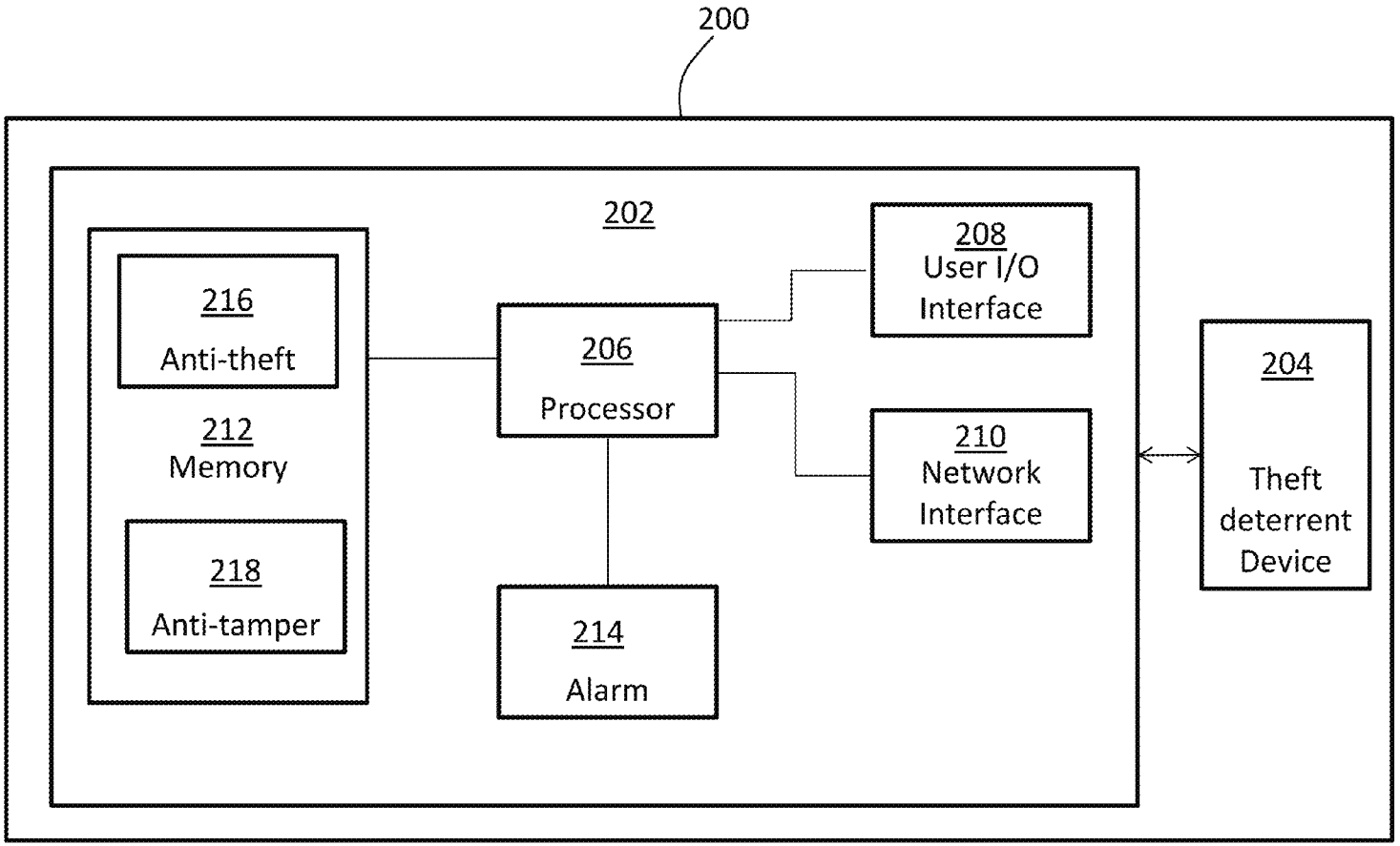
FIG. 2 is a block diagram of the anklet of FIG. 1, with a theft deterrent device, in accordance with an embodiment of the present invention.

Referring now to FIGS. 1-2, one embodiment of the present invention is shown in a schematic view. FIGS. 1-2 show several advantageous features of the present invention, but, as will be described below, the invention can be provided in several shapes, sizes, combinations of features and components, and varying numbers and functions of the components. The first example of a theft deterrent system 100, as shown in FIGS. 1-2, includes a wearable electronic monitoring device 102 and a wearable anti-tamper device 104 worn together on a supervised individual 106 as she passes through a pair of theft deterrent gates 108, 110.

The supervised individual 106 is an individual to be deterred from entrance into a retail environment, and/or an individual whose entrance into and exit from the retail environment warrants alerting the retail store. The term "retail environment" is used to indicate any environment where goods and/or services are offered for sale to the public for use or consumption, rather than for resale. As used herein, the term "supervised individual" is defined as any individual who wears a wearable electronic monitoring device that triggers an alarm condition upon entry into a monitored retail environment either voluntarily or under a requirement by law, rule, or other authority, or whose entrance into and exit from the retail environment is otherwise restricted or monitored. In one embodiment, the individual is a human being. In one embodiment, the supervised individual 106 is required, by a court order, to wear the wearable electronic monitoring device 102 on the supervised individual's 106 person at all times so that entrance into a monitored retail environment can trigger an alarm condition. In other embodiments, the court order requires the supervised individual 106 to wear both the wearable electronic monitoring device 102 and the wearable anti-tamper device 104 together on the supervised individual's 106 person at all times so that attempts to tamper with either of the devices 102, 104 can also cause an alarm condition. As will be explained in more detail below, the anti-tamper feature uses time-sensitive ping signals sent between the devices 102, 104 where failure of any one of the devices 102, 104 to send a ping signal to the other within a predetermined time period results in an alarm condition. Because both devices 102, 104 are worn by the supervised individual 106, the communications between the devices 102, 104 are preferably short range wireless communications.

The wearable electronic monitoring device 102 includes a wearable body 200 configured to be worn by the supervised individual 106. The wearable body 200 may be formed as any wearable article, such as an anklet, a bracelet, a ring or other accessory. As used herein, the term "wearable" is intended to indicate any portable device capable of being carried by or transported by an individual.

As illustrated in the block diagram of FIG. 2, embodiments of the wearable electronic monitoring device 102 can include a controller 202 and a theft deterrent device 204. The controller 202 can be, for example, a microcontroller, or a microprocessing device, including a "general purpose" microprocessing device or a special purpose microprocessing device. In some embodiments, the controller 202 is a small computer on a single integrated circuit (IC) with a processor, memory, and programmable input/output peripherals. In one embodiment, the controller 202 can include a processor 206, a user input-output interface 208, a network interface 210, memory 212, and an alarm 214.

The processor 206 executes code stored in the memory 212 in order to carry out operations and features of the wearable electronic monitoring device 102, in accordance with embodiments of the present invention. The processor 206 provides processing for one or more of the techniques described herein.

The user input-output interface 208 functions to provide a user a method of providing input to or output from the wearable electronic monitoring device 102, such as, for example, allowing a probation officer to input a unique alphanumeric code to deactivate the alarm condition. In another embodiment, the user input-output interface 208 can include a light-emitting diode (LED) or other light source that can emit light when an alarm condition is detected, such as the supervised individual 106 entering a monitored retail environment, or the supervised individual 106 tampering with one of the devices 102, 104.

The network interface 210 can include, for example, an antenna that can send and receive communications between the wearable electronic monitoring device 102 and the wearable anti-tamper device 104, such as the anti-tamper ping signals. In another embodiment, the network interface 210 can include, for example, a communications module to manage and configure communications between the controller 202 and the theft deterrent device 204. In another embodiment, the theft deterrent device 204 can be integrated into the controller 202, i.e., the theft deterrent device 204 can be provided on the same IC as the controller 202.

In yet other embodiments, the network interface 210 can include a Universal Serial Bus (USB) port for allowing a user, such as a probation officer, to receive alarm activity that may be stored in memory on the wearable electronic monitoring device 102, such as GPS location, time, and type of alarm condition (entry, exit, or tamper). The USB port may be connectable to a flash drive, or other non-volatile storage device that allows the probation officer to receive the alarm activity from the wearable electronic monitoring device 102. In other embodiments, the alarm activity may be communicated from the wearable electronic monitoring device 102 to the probation officer via wireless communications.

In some embodiments, the network interface 210 may include a personal area network (PAN) interface. The PAN interface may provide the capability for the wearable electronic monitoring device 102 to network using a short-range communication protocol, for example, a Bluetooth communication protocol. The PAN interface may permit the wearable electronic monitoring device 102 to connect wirelessly to another electronic device, such as the wearable anti-tamper device 104 via a peer-to-peer connection.

The network interfaces 210 may also include a local area network (LAN) interface. The LAN interface may be, for example, an interface to a wireless LAN, such as a Wi-Fi network. In one embodiment, there is a wireless LAN located at or near the retail environment that provides the wearable electronic monitoring device 102 with access to the Internet for receiving and sending communications via the Internet to and from, for example, the probation officer computer. The range of the LAN interface may generally exceed the range available via the PAN interface. Typically, a connection between two electronic devices via the LAN interface may involve communication through a network router or other intermediary device.

Additionally, the network interface 210 may include the capability to connect to a wide area network (WAN), such as the Internet, via a WAN interface. The WAN interface may permit a connection to a cellular mobile communications network, and/or the Internet. In another embodiment, the WAN interface can be a GPS interface that permits communication between the device 102 and a GPS system, for receiving location information. The WAN interface may include communications circuitry, such as an antenna coupled to a radio circuit having a transceiver for transmitting and receiving radio signals via the antenna. The WAN interface may permit communications between the wearable electronic monitoring device 102 and a computer associated with a probation officer or other law enforcement computer to communicate a monitored retail environment entry attempt to the probation officer or other law enforcement officer.

Memory 212 associated with the wearable electronic monitoring device 102 may be, for example, one or more buffer, one or more registers, a flash memory, or non-volatile memory, such as random access memory (RAM). The wearable electronic monitoring device 102 may also include non-volatile storage. The non-volatile storage may represent any suitable storage medium, such as a hard disk drive or non-volatile memory, such as flash memory. In one embodiment, the memory 212 stores an identification associated with the individual to be deterred from entrance into the retail environment, such as a unique alphanumeric code. When the probation officer computer receives the identification, it can determine which individual has triggered the alarm condition and which probation officer is assigned to the individual. Memory 212 can also include anti-theft 216 and anti-tamper 218 software modules configured to deter theft by detecting entry and exit attempts and device tampering attempts, respectively, in accordance with features described herein. In one embodiment, the memory 212 can include program instruction executable by the processor 206 to communicate a monitored retail environment entry attempt to an officer. As used herein, the term "officer" is defined herein as a probation officer, or any other law enforcement officer or authority. In a preferred embodiment, the alarm activity is stored in memory 212. The alarm activity may include a time that an alarm condition was triggered, a location where the alarm condition was triggered, and a type of alarm condition that was triggered (entrance, exit, and/or tamper).

In one embodiment, the alarm 214 is coupled to the wearable body 200 and is operably configured to communicate an alarm condition in response to at least one of the pair of theft deterrent gates 108, 110 detecting a signal 112 associated with the theft deterrent device 204. In a further embodiment, the signal 112 is formed as a digital signal generated by the theft deterrent device 204. In another embodiment, the alarm 214 includes a speaker or transducer operably configured to communicate an audio alarm condition in response to the theft deterrent gates 108, 110 detecting the signal 112 associated with the theft deterrent device 204. In some embodiments, the speaker can transmit a widely spaced apart low volume beeping sound when the supervised individual 106 is in close proximity to the monitored retail environment and the speaker can transmit a high volume sound when the supervised individual 106 has passed between the theft deterrent gates 108, 110. In another embodiment, the alarm 214 includes an LED or other light source that can blink and emit light in response to detecting a retail entrance attempt. In one embodiment, the light source can display a yellow light indicator warning the supervised individual 106 that she is in close proximity to the monitored retail environment and the light source can display a red light indicator signifying that the supervised individual 106 has entered the monitored retail environment. In some embodiments, the alarm 214 can include a vibration pack for vibrating the wearable electronic monitoring device 102 as an alarm condition. In yet another embodiment, the alarm condition can include a communication to store personnel of a monitored retail environment entry attempt by the supervised individual 106. The communication can be, for example, an audible alarm, a text message, an email message, a light indicator, or any other communication to a retail store computer, or station communicatively coupled to the theft deterrent system 100. In another embodiment, the alarm condition can include a communication to a probation officer computer or other law enforcement computer of a monitored retail environment entry attempt. As with the retail store computer, the communication to the probation office/law enforcement computer can be, for example, an audible alarm, a text message, an email message, a light indicator, or any other communication. In another embodiment, the communication can be stored in memory 212 associated with the wearable electronic monitoring device 102 for later retrieval. For example, instead of immediate communication of an alarm condition to the probation officer computer, such as a tamper condition or a retail environment entry/exit attempt, the device 104 or 102 can store each occurrence of the alarm condition in memory, which can later be retrieved by a probation officer during the supervised individual's 106 periodic meeting with her probation officer.

In one embodiment, the theft deterrent device 204 is coupled to the wearable body 200 and is operably configured to be detectable by at least one of the theft deterrent gates 108, 110. In another embodiment, the theft deterrent device 204 is operably configured to cause the signal 112 to be communicated, where the signal 112 is detectable by at least one theft deterrent gate 108, 110. The theft deterrent gates 108, 110 are disposed proximate an entrance area to the retail environment. In some embodiments, the entrance area is an entrance into a building. In other embodiments, the entrance area is an entrance into an area within a building, yet not the entrance into the building. In yet other embodiments, the entrance area is an entrance into a retail environment that is not housed within a building or other structure, such as an outdoor flea market. The theft deterrent device 204 can be communicatively coupled to the controller 202, or integrated into the controller 202.

In some embodiments, the theft deterrent gate 108 can be considered a transmitter gate and the theft deterrent gate 110 can be considered a receiver gate. In some embodiments, the transmitter gate transmits a first signal and the receiver gate is operably configured to detect a variation of the first signal indicative of the theft deterrent device 204 being within range of the receiver gate. In one exemplary embodiment, the transmitter gate transmits periodic, intermittent (or discontinuous) electrical or radio wave pulses or signals at regular time intervals. The receiver gate knows when it should receive a pulse/signal from the transmitter gate and when the receiver gate should not receive a pulse/signal from the transmitter gate. When, for example, an RF tag is within range of the gates 108, 110, the pulse/signal energizes the RF tag and the RF tag uses that energy to transmit a signal, which is received by the receiver gate. When the receiver gate receives a signal during a time period when it should not receive a signal from the transmitter gate, the receiver gate can determine that an RF tag may be present. In a like manner, in one embodiment, the theft deterrent device 204 can include a microprocessor with a transceiver (or separate transmitter and receiver) operably configured to generate the signal 112 so that the signal 112 is detectable by the receiver gate during the time period when the receiver gate is not expecting to receive a signal from the transmitter gate. In some embodiments, the signal 112 may include an identifying signal portion or some other indicator to differentiate a signal generated by the theft deterrent device 204 from a signal generated by a product-tracking RF tag.

In another exemplary embodiment, the transmitter gate transmits a continuous, cyclical magnetic wave, such as a sinusoidal waveform. The receiver gate receives the continuous magnetic wave. When, for example, a product-tracking tag is within range of the gates 108, 100, the product-tracking tag transmits a magnetic wave signal configured to mimic the transmitter gate's magnetic wave signal, except that the product-tracking tag's signal is delayed in such a manner that it results in an interference, which is detectable by the receiver gate. As a result of the receiver gate detecting the interference, the receiver gate determines that the product-tracking tag may be within range of the gates 108, 110. In a like manner, in one embodiment, the theft deterrent device 204, includes a microprocessor with a transceiver (or separate receiver and transmitter) that is operably configured to track the original magnetic wave signal of the transmitter gate and produce a signal that is substantially similar thereto, yet delayed so as to result in an interference detectable by the receiver gate. In some embodiments, the signal may include an identifying signal portion or some other indicator to differentiate detection of the theft deterrent device 204 from detection of a product-tracking tag.

In yet another exemplary embodiment, the transmitter gate transmits a continuous signal, which may be either a radio frequency or a magnetic signal. The product-tracking tag is operably configured to detect the continuous signal, and detection of said continuous signal decreases the field strength. The receiver gate is configured to detect the decrease in field strength and thereby determine that the product-tracking tag may be within range of the gates 108, 100. In a like manner, in one embodiment, the theft deterrent device 204 is operably configured to detect the continuous signal in a manner that decreases the field strength so that the receiver gate can detect the decrease in field strength. In some embodiments, the signal may include an identifying signal portion or some other indicator to differentiate detection of the theft deterrent device 204 from detection of a product-tracking tag.

Figure 3:
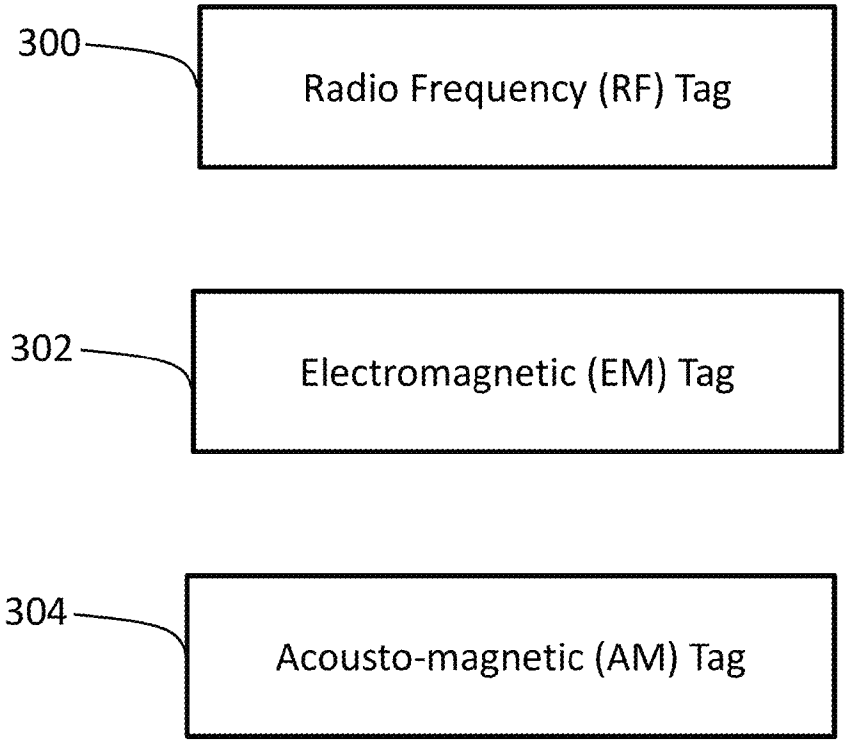
FIG. 3 is a block diagram of exemplary theft deterrent devices, formed as tags, in accordance with alternative embodiments of the present invention.

Referring to FIG. 3, the theft deterrent device 204 introduced in FIG. 2 can be implemented using a variety of technologies, including, but not limited to, a radio frequency (RF) tag 300, an electromagnetic (EM) tag 302, and an acousto-magnetic (AM) tag 304. In embodiments, the theft deterrent device 204 can be a passive tag, an active tag, or a semi-active tag. As is known in the art, passive tags do not require a separate battery as they use power harvested from a reader's electromagnetic field, while active and semi-active tags include a separate battery and therefore have a greater communication range.

Figure 4:
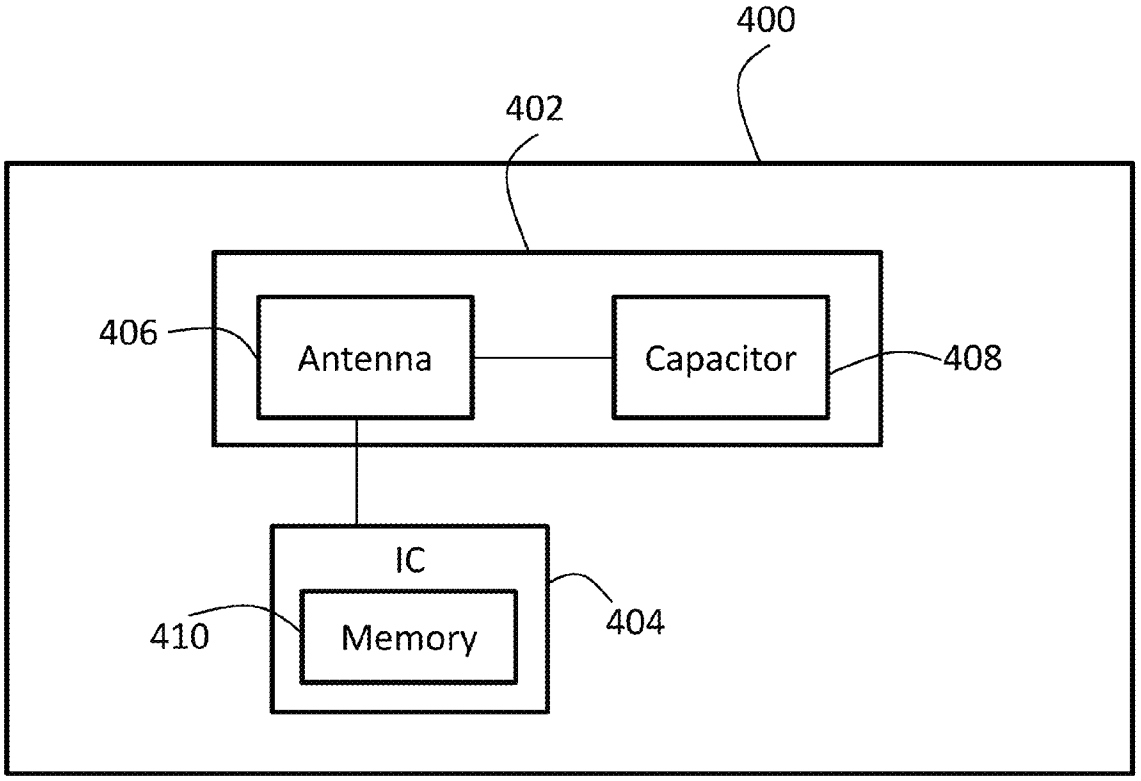
FIG. 4 is a block diagram of a radio frequency (RF) tag used with the theft deterrent system of FIG. 1, in accordance with an embodiment of the present invention.

Referring to FIG. 4, an exemplary theft deterrent device 204 (FIG. 2) is illustrated in a block diagram, formed as an RF tag 300. The RF tag 300 includes a substrate 400 to which a radio frequency (RF) circuit 402 and an IC 404 are coupled. The RF circuit 402 can include an antenna 406 and capacitor 408. The RF circuit 402 can be communicatively coupled to the IC 404, which includes memory 410. In one embodiment, the memory 410 is non-volatile memory that stores an identification associated with the individual to be deterred from entrance into the retail environment, i.e., the supervised individual 106. The identification can be a unique alphanumeric code assigned to the supervised individual 106. Each supervised individual 106 can have a unique code assigned to him or her so that entry and exit attempts can be tracked, stored, and/or counted, and so that the individual's 106 assigned probation officer can be notified in response to a monitored retail entry attempt. In one embodiment, the RF tag can operate at approximately 8.2 MHz. In another embodiment, the RF tag can operate between approximately 7 Mhz to approximately 8.2 Mhz. In yet a further embodiment, the RF tag can operate outside of these ranges.

As is known in the art, an EM tag includes a metal wire or ribbon with a high magnetic permeability. Embodiments of an EM tag-and-alarm system operate by applying a low frequency magnetic field generated by a transmitter antenna in an EAS transmitter gate. When the EM tag passes through the gates, the tag transmits a unique frequency pattern that is detected by a receiver antenna in a corresponding EAS receiver gate. In one embodiment, the EM tag can operate between approximately 70 Hz to approximately 1 kHz. In another embodiment, the EM tag can operate outside of this range.

As is known in the art, an AM tag is highly magnetostrictive, which means that it physically shrinks in a magnetic field. When the AM tag passes through the gates, a transmitter in an EAS transmitter gate energizes the AM tag material, causing it to resonate at a particular frequency, F. The AM tag continues to resonate at F. A receiver in a corresponding EAS receiver gate is able to detect signals that resonate at F. In yet another embodiment, the theft deterrent device 204 is not formed as a tag, but as an electronic device or circuit configured to generate a digital signal that reproduces an analog tag signal, the reproduced signal detectable by at least one theft deterrent gate device for causing an alarm condition. The theft deterrent device 204 can be formed as any device operably configured to be detectable by at least one theft deterrent gate device, resulting in an alarm condition. In one embodiment, the AM tag can operate at approximately 58 kHz. In another embodiment, the AM tag can operate outside of this range.

Figure 5:
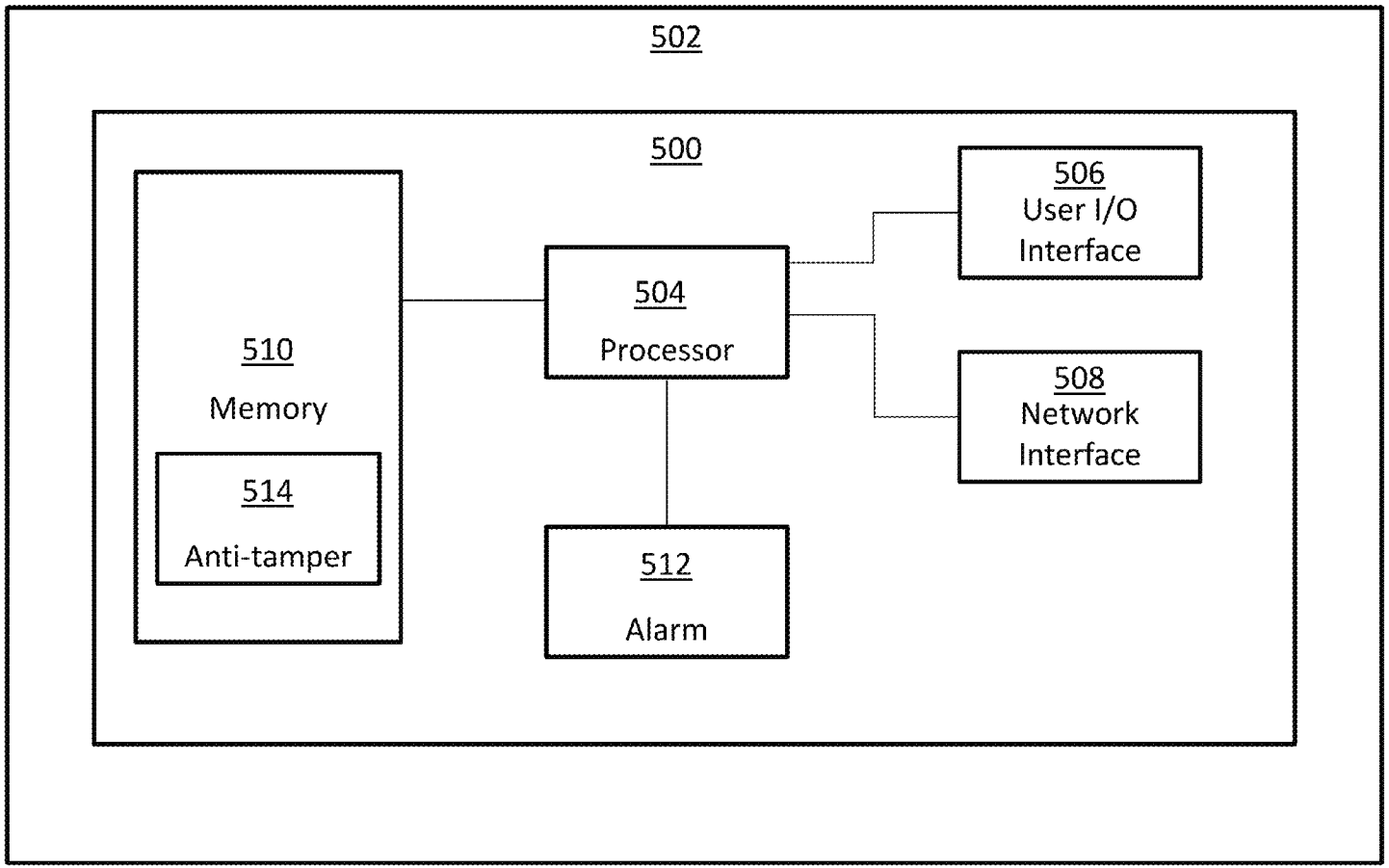
FIG. 5 is a block diagram of the bracelet of FIG. 1, with an anti-tamper module, in accordance with an embodiment of the present invention.

Referring now to FIG. 5, an exemplary embodiment of the wearable anti-tamper device 104 is illustrated in a block diagram. The wearable anti-tamper device 104 is operably configured to be worn by the supervised individual 106 together with the wearable electronic monitoring device 102. The wearable anti-tamper device 104 is communicatively coupled to the wearable electronic monitoring device 102. The devices 102, 104 are preferably configured to communicate via a short range wireless communication protocol and network.

In one embodiment, the wearable anti-tamper device 104 includes a controller 500 coupled to a wearable body 502. The wearable body 502 may be formed as any wearable article, such as an anklet, a bracelet, a ring or other accessory.

The controller 500 can be, for example, a microcontroller, or a microprocessing device, including a "general purpose" microprocessing device or a special purpose microprocessing device. In some embodiments, the controller 500 is a small computer on a single integrated circuit (IC) with a processor, memory, and programmable input/output peripherals. In one embodiment, the controller 500 can include a processor 504, a user input-output interface 506, a network interface 508, memory 510, and an alarm 512.

The processor 504 executes code stored in the memory 510 in order to carry out operations and features of the wearable anti-tamper device 104, in accordance with embodiments of the present invention. The processor 504 provides processing for one or more of the anti-tamper techniques described herein.

The user input-output interface 506 functions to provide a user a method of providing input to or output from the wearable anti-tamper device 104, such as, for example, a speaker or vibration pack configured to emit an audible alert or vibration, respectively, in response to a tamper alarm condition. In another embodiment, the user input-output interface 506 can include a light-emitting diode (LED) or other light source that can emit light when a tamper alarm condition is detected.

The network interface 508 can include, for example, an antenna that can send and receive communications between the wearable electronic monitoring device 102 and the wearable anti-tamper device 104 (FIG. 1), such as the anti-tamper ping signals. The antenna can be communicatively coupled to the controller 500. In one embodiment, the antenna is included in the controller 500 by, for example, being included within the same IC as the controller 500. In another embodiment, the antenna is a peripheral component to the controller 500. In yet another embodiment, the network interface 508 can include, for example, a communications module to manage and configure communications between the controller 500 and the probation officer or law enforcement computer.

In yet other embodiments, the network interface 508 can include a Universal Serial Bus (USB) port for allowing a user, such as a probation officer, to receive alarm activity that may be stored in memory on the wearable anti-tamper device 104, such as GPS location, time, and type of alarm condition (entry, exit, or tamper). The USB port may be connectable to a flash drive, or other non-volatile storage device that allows the probation officer to receive the alarm activity from the wearable anti-tamper device 104. In other embodiments, the alarm activity may be communicated from the wearable anti-tamper device 104 to the probation officer via wireless communications.

In some embodiments, the network interface 508 may include a personal area network (PAN) interface. The PAN interface may provide the capability for the wearable anti-tamper device 104 to network using a short-range communication protocol, for example, a Bluetooth communication protocol. The PAN interface may permit the wearable anti-tamper device 104 to connect wirelessly to another electronic device, such as the wearable electronic monitoring device 102 via a peer-to-peer connection.

The network interface 508 may also include a local area network (LAN) interface. The LAN interface may be, for example, an interface to a wireless LAN, such as a Wi-Fi network. In one embodiment, there is a wireless LAN located at or near the retail environment that provides the device 104 with access to the Internet for receiving and sending communications via the Internet to and from, for example, the probation officer computer. The range of the LAN interface may generally exceed the range available via the PAN interface. Typically, a connection between two electronic devices via the LAN interface may involve communication through a network router or other intermediary device.

Additionally, the network interface 508 may include the capability to connect to a wide area network (WAN), such as the Internet, via a WAN interface. In another embodiment, the WAN interface can be a GPS interface that permits communication between the device 104 and a GPS system, for receiving location information associated with the device 104. The WAN interface may permit a connection to a cellular mobile communications network, and/or the Internet. The WAN interface may include communications circuitry, such as an antenna coupled to a radio circuit having a transceiver for transmitting and receiving radio signals via the antenna. The WAN interface may permit communications between the wearable anti-tamper device 104 and a computer associated with a probation officer or other law enforcement computer to communicate a tampering attempt to the probation officer or other law enforcement officer.

Memory 510 associated with the wearable anti-tamper device 104 may be, for example, one or more buffer, one or more registers, a flash memory, or non-volatile memory, such as random access memory (RAM). The wearable anti-tamper device 104 may also include non-volatile storage. The non-volatile storage may represent any suitable storage medium, such as a hard disk drive or non-volatile memory, such as flash memory. In one embodiment, the memory 510 stores a predetermined time period that is used by the device 104 to determine whether a tamper condition has occurred. In one embodiment, the alarm activity is stored in memory 510. The alarm activity may include a time that an alarm condition was triggered, a location where the alarm condition was triggered, and a type of alarm condition that was triggered (entrance, exit, and/or tamper).

In one embodiment, the alarm 512 is coupled to the wearable body 502 and is operably configured to communicate a tamper alarm condition in response to determining that a tamper condition has occurred. The alarm 512 can be considered an anti-tamper alarm and can be communicatively coupled to the controller 500. In one embodiment, the alarm 512 is included in the controller 500 by, for example, being included within the same IC as the controller 500. In another embodiment, the alarm 512 is a peripheral component to the controller 500. In some embodiments, the alarm 512 can include a speaker to emit an audio alarm, a vibration pack to generate a tactile alarm, or a light source to emit a visual alarm. In yet another embodiment, the alarm 512 can communicate to a probation officer computer or other law enforcement computer that a tamper condition has been detected. The communication to the probation office/law enforcement computer can be, for example, an audible alarm, a text message, an email message, a light indicator, or any other communication. In another embodiment, the communication can be stored in memory 510 associated with the wearable anti-tamper device 104 for later retrieval. For example, instead of immediate communication of an alarm condition to the probation officer computer, such as a tamper condition or a retail environment entry attempt, the device 104 or 102 can store each occurrence of the alarm condition in memory, which can later be retrieved by a probation officer during the supervised individual's 106 periodic meeting with her probation officer.

In one embodiment, the memory 510 can also include an anti-tamper 514 software module configured to deter device tampering, in accordance with features described herein. In one embodiment, the memory 510 can include program instruction executable by the processor 504 to send to and receive anti-tamper ping signals from the wearable electronic monitoring device 102 and determine whether a tamper alarm condition is triggered.

Figure 6:
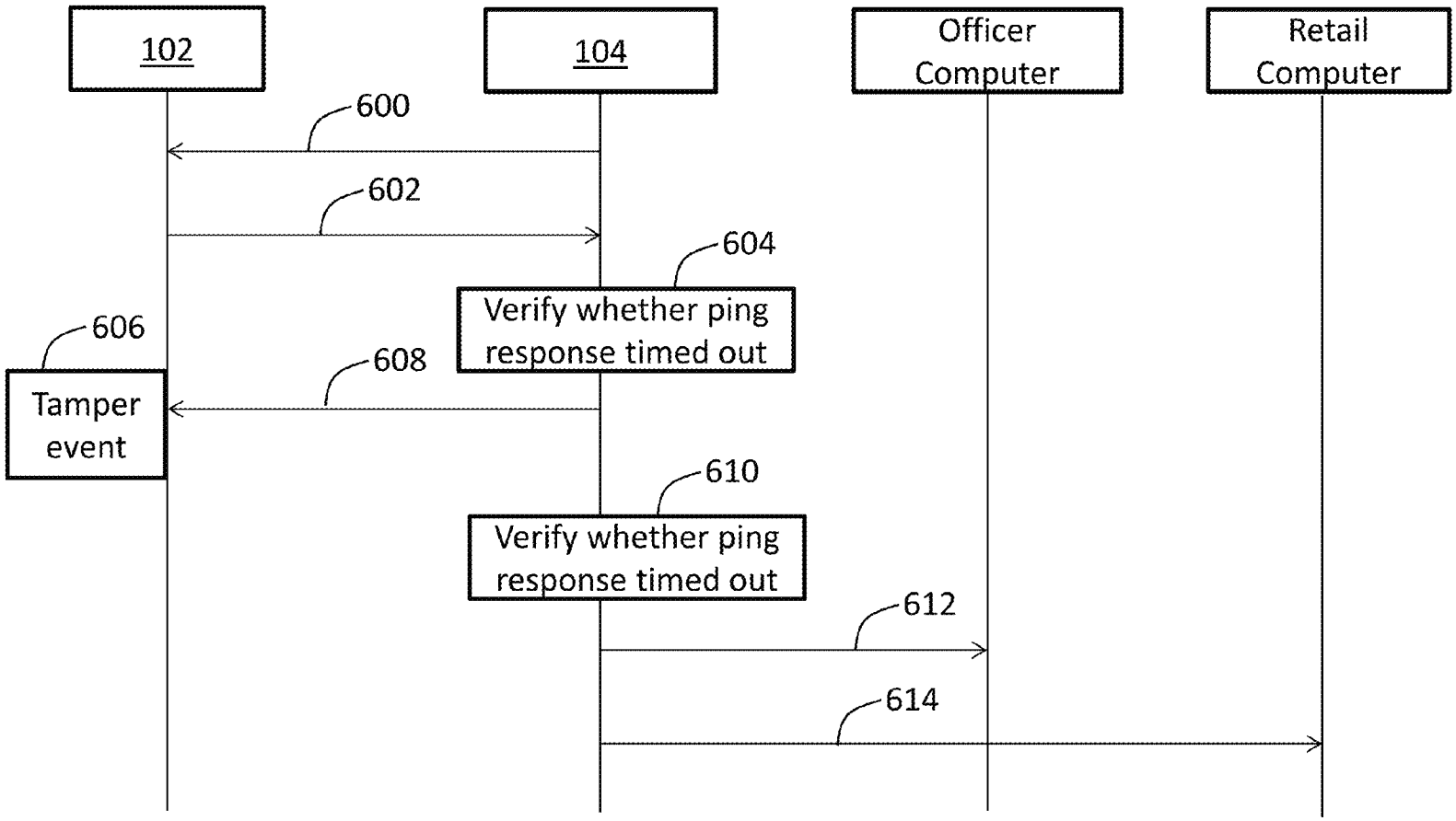
FIG. 6 is a signaling flow chart in accordance with an exemplary embodiment of the present invention.

Referring to FIG. 6, an exemplary method of detecting a tamper condition is illustrated in a signaling flow chart. The wearable anti-tamper device 104 can be configured to communicate a first anti-tamper ping signal to the wearable electronic monitoring device 102 at 600. After the wearable electronic monitoring device 102 receives the first anti-tamper ping signal, the wearable electronic monitoring device 102 communicates a second anti-tamper ping signal to the wearable anti-tamper device 104 at 602. The wearable anti-tamper device 104 is configured to receive the second anti-tamper ping signal from the wearable electronic monitoring device 102. At 604, the wearable anti-tamper device 104 determines whether the second anti-tamper ping signal is received in response to the first anti-tamper ping signal within a predetermined time period. The predetermined time period can be any time period. In some embodiments, the predetermined time period can be, for example, one or more seconds. If the wearable anti-tamper device 104 does not detect a tamper condition, the wearable anti-tamper device 104 will not cause an alarm condition. In some embodiments, the anti-tamper ping signal communications between the devices 102, 104 are implemented as radio frequency signals transmitted via an antenna within each device 102, 104.

In the exemplary method, at 606, a tamper event occurs. Tamper events can include, for example, removing either or both devices 102, 104 from the person of the supervised individual 106, or covering either or both devices 102, 104 with a signal disrupting material (e.g., foil). At 608, the wearable anti-tamper device 104 communicates another anti-tamper ping signal to the wearable electronic monitoring device 102. As a result of the tamper event, the wearable electronic monitoring device 102 is not able to receive the anti-tamper ping signal, and/or communicate a response ping signal to the wearable electronic monitoring device 102. Therefore, at 610, the ping response times out and the wearable anti-tamper device 104 determines that the response anti-tamper ping signal is not received within the predetermined time period. At 612 and 614, the wearable anti-tamper device 104 causes the anti-tamper alarm 512 (FIG. 5) to communicate a tamper alarm condition in response to determining that the response anti-tamper ping signal was not received from the wearable electronic monitoring device 102 within the predetermined time period. At 612, the wearable anti-tamper device 104 communicates to an officer computer that a tamper condition has occurred by the supervised individual 106. At 614, the wearable anti-tamper device 104 communicates to a computer associated with the retail environment that a tamper condition has occurred. In one embodiment, the communications at 612 and 614 are sent in real-time, or almost immediately in response to detecting a tamper condition so that officers and store personnel can act quickly to prevent/deter theft by apprehending the supervised individual 106. In a further embodiment, the tamper condition is stored on the memory 510 of the wearable anti-tamper device 104. The tamper condition can include time and location that the tamper event occurred.

Figure 7:
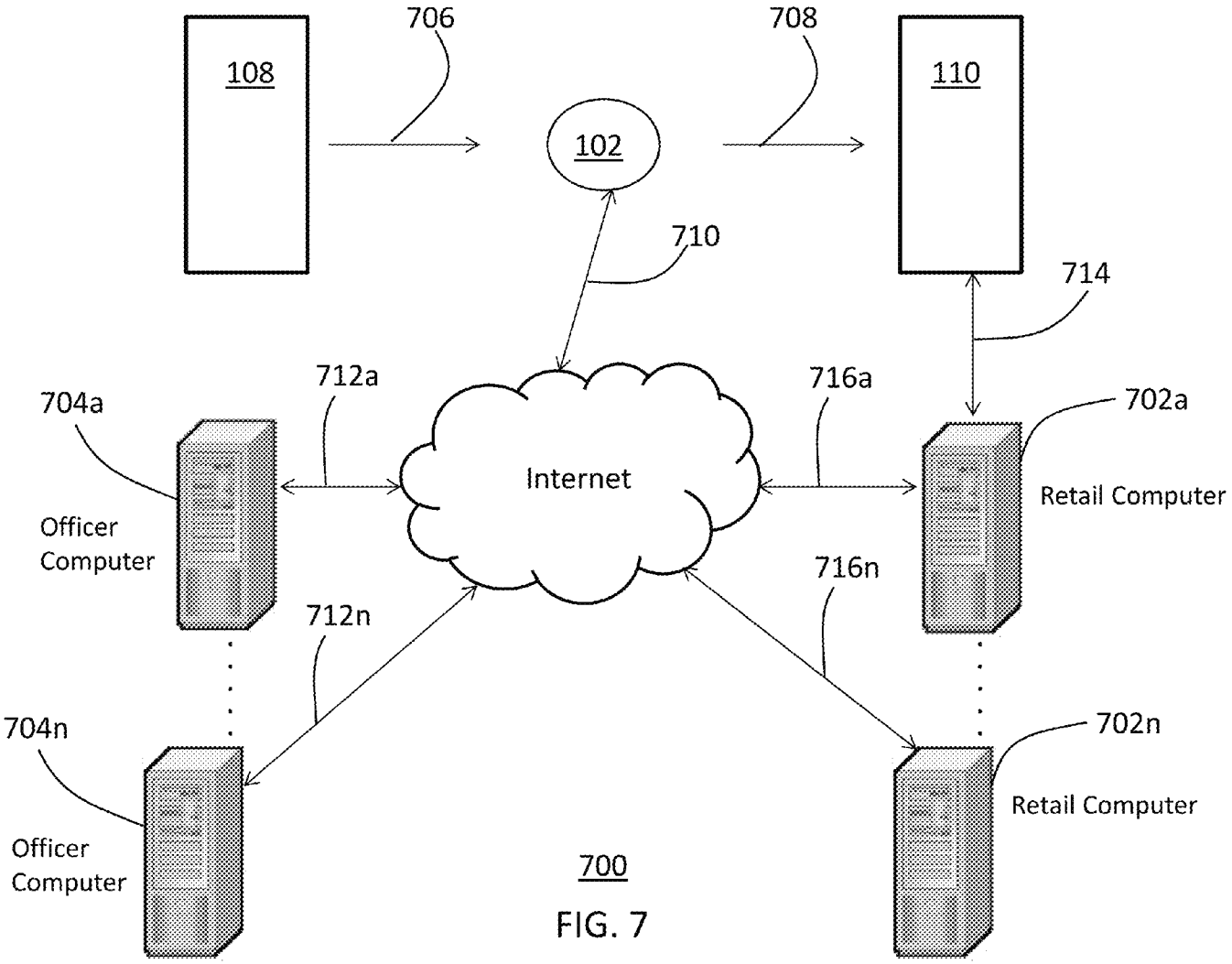
FIG. 7 is block diagram of a data processing system that may be implemented as a network device, such as a retail computer or probation officer computer, in accordance with an embodiment of the present invention.

Referring to FIG. 7, an exemplary distributed data processing network 700 is illustrated as a block diagram. In one embodiment, the network 700 includes the pair of theft deterrent gates 108, 110, the wearable electronic monitoring device 102, a retail computer 702*a-n*, and an officer computer 704*a-n*. The retail computer 702*a-n* is configured to access a list of individual's whose entrance into and exit from the retail environment associated with the retail computer 702*a-n* is supervised and determine if the identification from the theft deterrent device 204 matches an identification associated with an individual in the list and, therefore, warrants an alarm condition.

In one embodiment, an individual wearing the wearable electronic monitoring device 102 travels between the pair of theft deterrent gates 108, 110, which are positioned proximate an entrance to a retail environment. One of the pair of theft deterrent gates 108 can be considered a transmitter gate having an antenna that transmits radio signals 706. The other of the pair of theft deterrent gates 110 can be considered a receiver gate having an antenna that receives radio signals 708. In one embodiment, the theft deterrent device 204 on the wearable electronic monitoring device 102 receives the radio signals 706 from the transmitter gate 108. In response to receiving the radio signals 706, the theft deterrent device 204 transmits the identification associated with the supervised individual 106, which is received by the receiver gate 110.

As a result of the receiver gate 110 receiving the identification, an alarm condition is communicated. In one embodiment, the wearable electronic monitoring device 102 emits an audio and/or visual alarm from output devices associated with the alarm 214, such as a speaker and/or an LED. In another embodiment, the wearable electronic monitoring device 102 communicates to the officer computer 704*a-n* via a communication link 710 to alert a probation officer or other law enforcement officer that a monitored retail environment entry attempt has been made by the individual associated with the identification. The number between "a" through "n" can be any number. The communication link 710 may be wired or wireless. In a preferred embodiment, the audio alarm can only be disabled by the probation officer. In another preferred embodiment, the audio alarm automatically stops after a predetermined time period. The predetermined time period for the audio alarm can be stored in memory and a timer can count down according to the predetermined time period. In one embodiment, the predetermined time period is one minute, where the audio alarm continues to sound for one minute and then automatically stops. In another embodiment, the predetermined time period is five minutes, where the audio alarm continues to sound for five minutes and then automatically stops. The predetermined time period can be outside of these ranges in other embodiments. In one embodiment, the communication link 710 may provide a connection to a WAN, such as the Internet, which allows access to the officer computer 704*a-n* via a communication link 712*a-n*, which may be a wired or a wireless communication link.

In yet another embodiment, the receiver gate 110 can communicate to the retail computer 702*a-n* via a communication link 714, which may be wired or wireless. In one embodiment, the retail computer 702*a-n* receives a communication of the identification associated with the supervised individual 106 from the receiver gate 110 via the communication link 714. In some embodiments, the communication link 714 may provide a connection to a WAN, such as the Internet, or another network. In another embodiment, the retail computer 702*a-n* receives a communication of the identification associated with the supervised individual 106 from the wearable electronic monitoring device 102 via the Internet, a radio signal, or another network. In some embodiments, the retail computer 702*a-n* determines whether the identification corresponds to one of a plurality of identifications associated with individuals to be deterred from entrance into the retail environment, which may be stored in memory on the retail computer 702. In one embodiment, in response to the identification corresponding to one of the plurality of identifications stored in memory, the retail computer 702*a-n* causes an alarm condition, such as causing an audible or visual alarm, or communicating the monitored entry attempt to a probation officer or a law enforcement officer via a communication link 716*a-n*. The communication link 716*a-n* can be wired or wireless.

Figure 8:
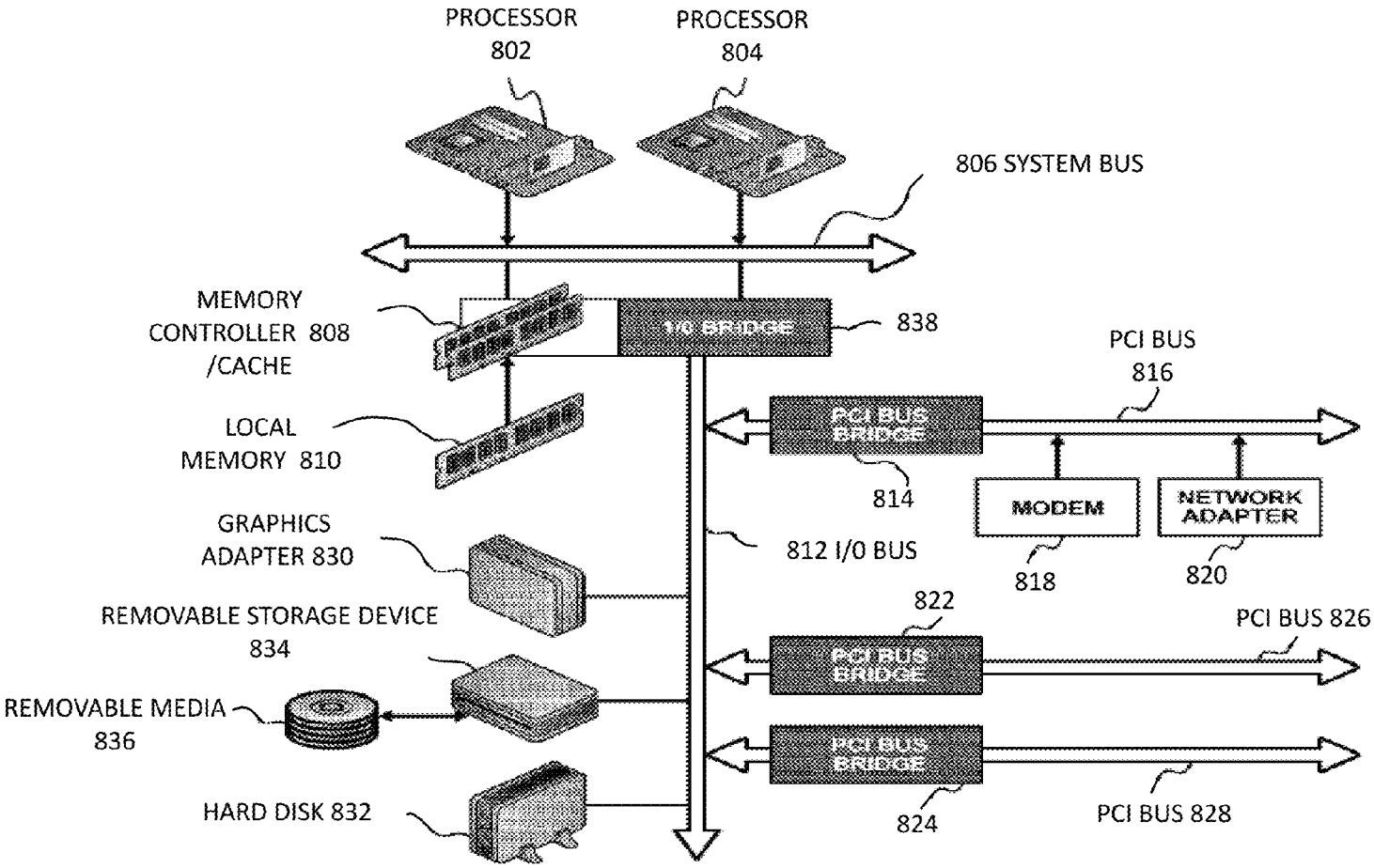
FIG. 8 is a block diagram of an exemplary distributed data processing network with a pair of security gates, an electronic monitoring device, a retail computer, and a probation officer computer in accordance with an embodiment of the present invention.

Referring to FIG. 8, a block diagram of a data processing system 800 that may be implemented as a computer or server, such as the retail computer or officer computer, or implemented as a personal computer, mobile electronic device, recording device, or other computing device coupled to the network 700, as shown in FIG. 7, in accordance with one embodiment of the present invention is shown. The data processing system 800 may be a symmetric multiprocessor (SMP) system including a plurality of processors 802 and 804 connected to system bus 806. Alternatively, a single processor system may be employed. Also, connected to system bus 806 is memory controller/cache 808, which provides an interface to local memory 810. An I/O bus bridge 838 is connected to system bus 806 and provides an interface to I/O bus 812. The memory controller/cache 808 and I/O bus bridge 838 may be integrated as depicted. The processor 802 or 804 in conjunction with memory controller 808 controls what data is stored in memory 810. The processor 802 and/or 804 and memory controller 808 can serve as a data counter for counting the rate of data flow to the memory 810 or from the memory 810 and can also count the total volume of data accessed to or from the memory 810. The processor 802 or 804 can also work in conjunction with any other memory device or storage location.

Peripheral component interconnect (PCI) bus bridge 814 connected to I/O bus 812 provides an interface to PCI local bus 816. A number of modems 818, or wireless cards, may be connected to PCI bus 816. Typical PCI bus implementations will support four PCI expansion slots or add-in connectors. PCI includes, but is not necessarily limited to, PCI-X and PCI Express components. Communications links to the network of computers in FIGS. 1 and 2 may be provided through the modem 818 and network adapter 820 connected to PCI local bus 816 through add-in boards.

Additional PCI bus bridges 822 and 824 provide interfaces for additional PCI buses 826 and 828, from which additional modems or network adapters may be supported. In this manner, the data processing system 800 allows connections to a multiple network of computers. A graphics adapter 830 and hard disk 832 may also be connected to I/O bus 812 as depicted, either directly or indirectly.

Those of ordinary skill in the art will appreciate that the hardware depicted in FIG. 8 may vary. For example, other peripheral devices, such as optical disk drives and the like, also may be used in addition to or in place of the hardware depicted. The depicted example is not meant to imply architectural limitations with respect to the present invention.

The processes explained in detail above can be embodied in a computer program. Computer programs (also called computer control logic) are stored in memory such as main memory 810, removable storage drive 834, removable media 836, hard disk 832, and signals. Such computer programs, when executed, enable the computer system to perform the features of the present invention as discussed herein. In particular, the computer programs, when executed, cause the processor 802 and/or 804 to perform the features of the theft deterrent system 100.

In this document, the terms "computer program medium," "computer usable medium," and "computer readable medium" are used to generally refer to media such as main memory 810, removable storage drive 834, removable media 836, hard disk 832, and signals. These computer program products are means for providing software to the computer system. The computer readable medium allows the computer system to read data, instructions, messages or message packets, and other computer readable information from the computer readable medium. The computer readable medium, for example, may include non-volatile memory, such as Floppy, ROM, Flash memory, Disk drive memory, CD-ROM, and other permanent storage. It is useful, for example, for transporting information, such as data and computer/programming instructions, between computer systems. Furthermore, the computer readable medium may comprise computer readable information in a transitory state medium such as a network link and/or a network interface, including a wired or wireless network, that allows a computer to read such computer readable information.

Figure 9:
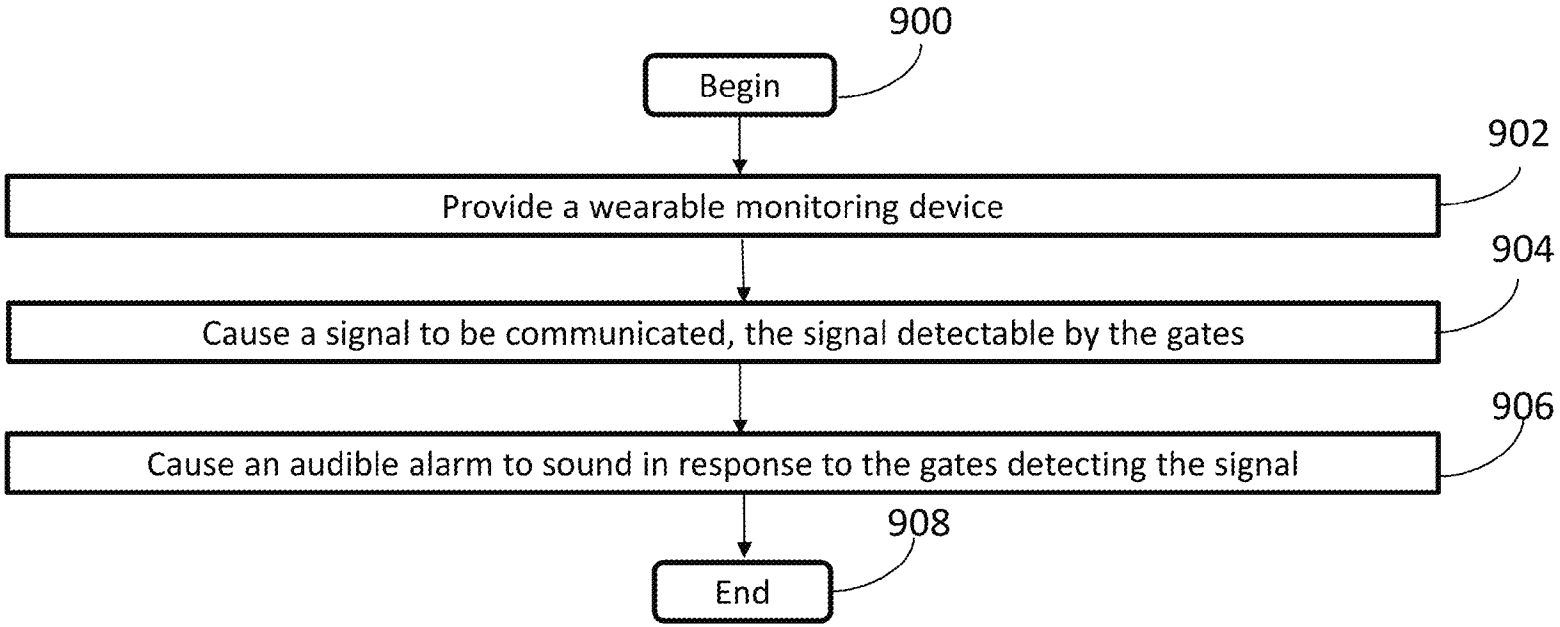
FIG. 9 is process flow chart representing an exemplary method of deterring entrance of supervised individuals from entering in a retail environment in accordance with the present invention.

Referring to FIG. 9 in conjunction with FIG. 1, an exemplary process of deterring entrance of supervised individuals 106 into a monitored retail environment is illustrated in a flow chart. The process begins at step 900 and immediately proceeds to step 902, where the wearable electronic monitoring device 102 associated with the supervised individual 106 is provided to the supervised individual 106. At step 904, the theft deterrent device 204 causes a signal to be communicated, the signal detectable by at least one of the pair of theft deterrent gate devices 108, 110 disposed proximate an entrance area into the monitored retail environment. At step 906, in response to the theft deterrent gate devices 108, 110 detecting the signal, an audible alarm is sounded. In one embodiment, the audible alarm is emitted by a speaker within the wearable electronic monitoring device 102. In another embodiment, the audible alarm is emitted by a speaker within the pair of theft deterrent gate devices. In yet another embodiment, both the wearable electronic monitoring device 102 and the pair of theft deterrent gate devices 108, 110 include a speaker and both audible alarms are triggered at the same time. As used herein, the term "gate device" is defined as any device positioned proximate an entrance and/or an exit. In one embodiment, the theft deterrent gate device can be formed as 20*a* single device positioned proximate an entrance/exit, rather than a pair of entrance gates. The process ends at step 908.

Figure 10:
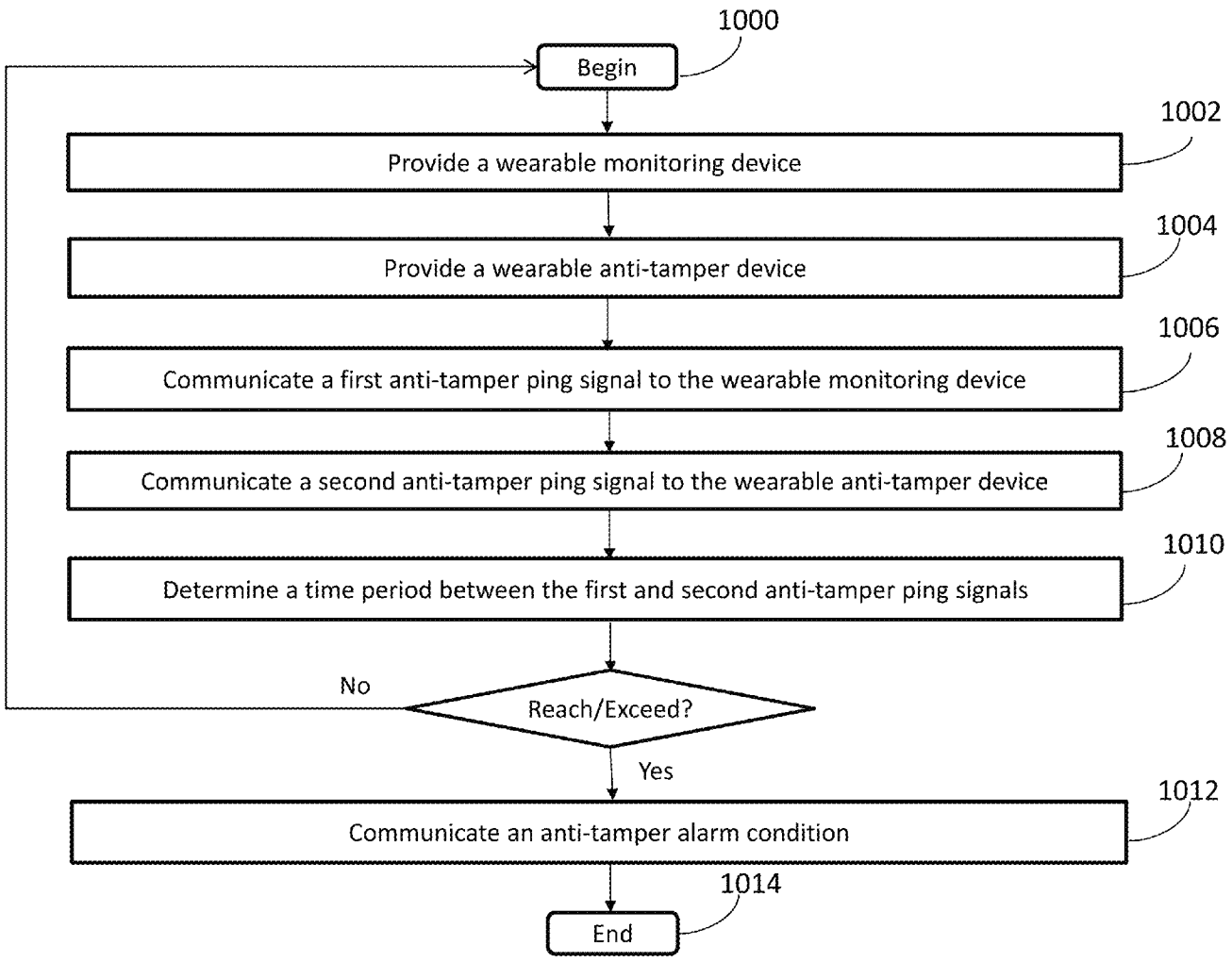
FIG. 10 is a process flow chart representing an exemplary method of detecting a tamper event in accordance with the present invention.

Referring to FIG. 10 in conjunction with FIG. 1, an exemplary process of detecting a tamper condition of the devices 102, 104 is illustrated in a flow chart. The process begins at step 1000 and immediately proceeds to step 1002, where the wearable electronic monitoring device 102 is provided to the supervised individual 106. At step 1004, the wearable anti-tamper device 104, which is communicatively coupled to the wearable electronic monitoring device 102, is provided to the supervised individual 106. At step 1006, the wearable anti-tamper device 104 communicates a first anti-tamper ping signal to the wearable electronic monitoring device 102. At step 1008, the wearable electronic monitoring device 102 communicates a second anti-tamper ping signal to the wearable anti-tamper device 104. At step 1010, the wearable anti-tamper device 104 determines a time period between the first anti-tamper ping signal and the second anti-tamper ping signal. If the time period does not reach or exceed a predetermined time period, the process returns to step 1000, and the process begins again. Alternatively, if the time period reaches or exceeds the predetermined time period, at step 1012, an anti-tamper alarm condition is communicated. In one embodiment, the anti-tamper alarm condition includes an audible alarm emitted by a speaker within one or both of the devices 102, 104. In another embodiment, the anti-tamper alarm condition includes communicating that an anti-tamper event occurred to the probation officer or law enforcement officer. In yet another embodiment, the anti-tamper alarm condition includes saving an anti-tamper event occurrence within the memory of the wearable anti-tamper device 104 for later retrieval by a probation officer or other law enforcement officer. The anti-tamper event occurrence can include the time and location of the anti-tamper event. The process ends at step 1014.

Figure 11:
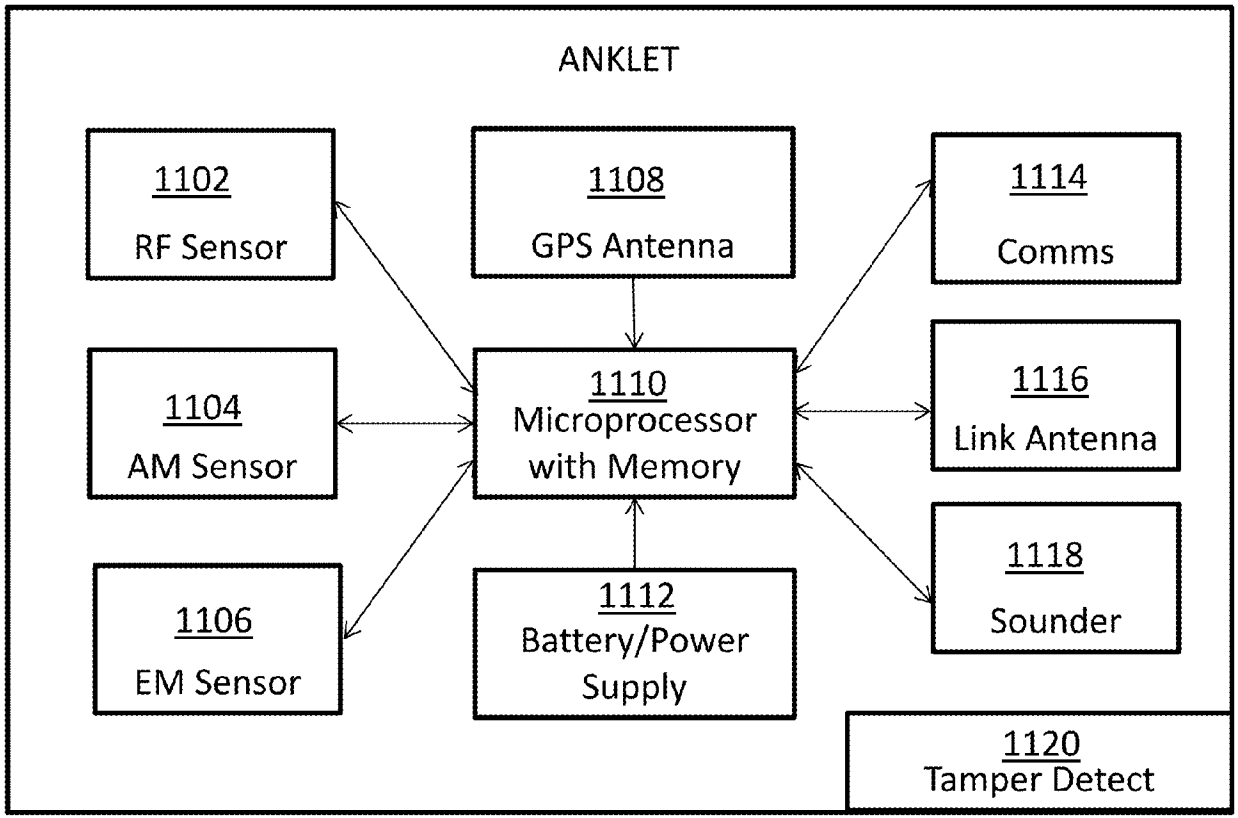
FIG. 11 is a block diagram of another exemplary anklet in accordance with an embodiment of the present invention.

Referring to FIG. 11, another exemplary wearable electronic monitoring device 1100, formed as an anklet, is illustrated in a block diagram. The wearable electronic monitoring device 1100 can include an RF sensor 1102, an AM sensor 1104, an EM sensor 1106, a GPS antenna 1108, a microprocessor with memory 1110, a battery (or power supply) 1112, a communications interface 1114, a link antenna 1116, a sounder 1118, and a tamper detect module 1120. In some embodiments, each of the sensors 1102, 1104, and 1106 is configured to detect a corresponding output from at least one theft deterrent gate device 108, 110. In another embodiment, the GPS antenna 1108 is configured to receive GPS location data for indicating a location of the supervised individual 106. In a further embodiment, the microprocessor 1110 is configured to execute a set of computer instructions stored within memory resident on the microprocessor 1110, the computer instructions configured to execute one or more of the features described herein. In another embodiment, the battery 1112 can include a rechargeable battery. In one embodiment, the rechargeable battery may be powered by the movement of the supervised individual 106 (FIG. 1), wearing the wearable electronic monitoring device 1100. In another embodiment, the link antenna 116 is operable to communicate with peripheral devices, such as a wearable anti-tamper device 1200 (FIG. 12) or the theft deterrent gates 108, 110. The sounder 1118 can be a speaker, operable to emit an audible sound in response to an alarm condition. In one embodiment, the tamper detect module 1120 includes circuitry and/or computer instructions for communicating to and receiving anti-tamper ping signals from the wearable anti-tamper device 1200 (FIG. 12) for detecting potential tamper events.

Figure 12:
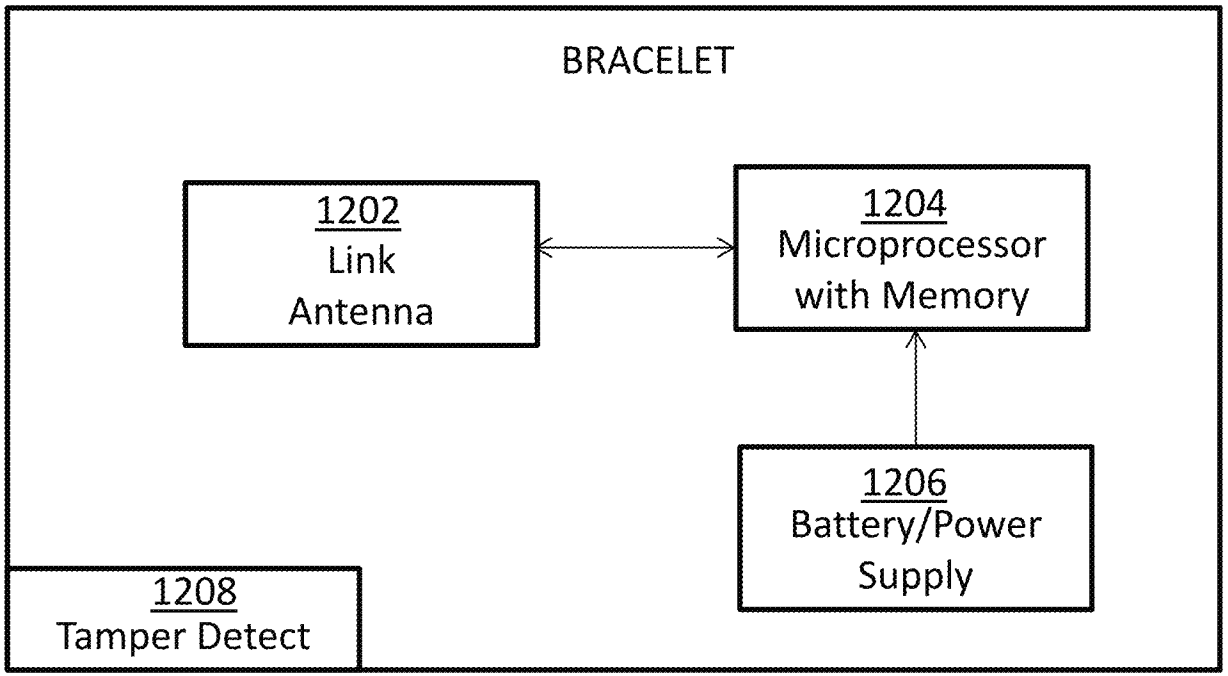
FIG. 12 is a block diagram of another exemplary bracelet in accordance with an embodiment of the present invention.

Referring to FIG. 12, another exemplary wearable anti-tamper device 1200, formed as a bracelet, is illustrated in a block diagram. The wearable anti-tamper device 1200 can include a link antenna 1202, a microprocessor with memory 1204, a battery (or power supply) 1206, and a tamper detect module 1208. In one embodiment, the link antenna 1202 is operable to communicate with peripheral devices, such as the wearable electronic monitoring device 1100 (FIG. 11) or the theft deterrent gates 108, 110. In another embodiment, the microprocessor 1204 is configured to execute a set of computer instructions stored within memory resident on the microprocessor 1204, the computer instructions configured to execute one or more of the features described herein. In another embodiment, the battery 1206 can include a rechargeable battery. In one embodiment, the rechargeable battery may be powered by the movement of the supervised individual 106 (FIG. 1), wearing the wearable anti-tamper device 1206. In one embodiment, the tamper detect module 1208 includes circuitry and/or computer instructions for communicating to and receiving anti-tamper ping signals from the wearable electronic monitoring device 1100 (FIG. 11) for detecting potential tamper events.

A system and method for deterring repeat offender shoplifters from entering monitored retail environments and/or alerting retail stores of repeat offender shoplifters' entry into and exit from the retail environment has been disclosed, which provides a theft deterrent anklet that is able to communicate with current retail gate security systems to sound an audible alarm when the gate detects the theft deterrent anklet. In addition, an anti-tamper bracelet communicatively coupled to the theft deterrent anklet and configured to be worn together with the theft deterrent anklet continuously monitors for tampering with periodic ping signals to the theft deterrent anklet. Failure of the anti-tamper bracelet to receive a response ping signal from the theft deterrent anklet results in an anti-tamper alarm condition.

What is claimed is:

1. A wearable electronic monitoring device for deterring and/or monitoring entrance of an individual wearing the device into an area, the device comprising:

a wearable body configured to be worn by an individual to be deterred from entrance into a retail environment;

a theft deterrent device coupled to the wearable body, the theft deterrent device operably configured to be detectable by at least one theft deterrent gate device disposed proximate an entrance area to the retail environment; and an alarm coupled to the wearable body and operably configured to communicate an alarm condition in response to the at least one theft deterrent gate device detecting the theft deterrent device.

2. The wearable electronic monitoring device in accordance with claim 1, further comprising:

memory storing an identification associated with the individual to be deterred from entrance into the retail environment.

3. The wearable electronic monitoring device in accordance with claim 1, further comprising:

a controller having a processor and memory; and program instructions stored in memory and executable by the processor to perform the step of:

communicating a monitored retail environment entry attempt.

4. The wearable electronic monitoring device in accordance with claim 1, wherein the alarm includes:

a speaker operably configured to communicate an audio alarm condition in response to the at least one theft deterrent gate device detecting the theft deterrent device.

5. The wearable electronic monitoring device in accordance with claim 1, wherein:

the at least one theft deterrent gate device includes:

a transmitter gate operably configured to transmit a first signal; and a receiver gate operably configured to receive the first signal from the transmitter gate and operably configured to detect a variation of the first signal indicative of the theft deterrent device being within range of the receiver gate, the variation including at least one of:

an interference with the first signal;

a decrease in a strength of the first signal; and a second signal transmitted by the theft deterrent device between periodic, discontinuous pulses of the first signal.

6. The wearable electronic monitoring device in accordance with claim 1, wherein:

the theft deterrent device is formed as at least one of:

a radio frequency tag;

an electromagnetic tag; and an acousto-magnetic tag.

7. The wearable electronic monitoring device in accordance with claim 1, wherein:

the wearable body is formed as at least one of:

an anklet; and a bracelet.

8. A monitoring system for deterring and/or monitoring entrance of supervised individuals into an area, the system comprising:

a wearable monitoring device configured to be worn by an individual to be deterred from entrance into a retail environment, the wearable monitoring device including:

a theft deterrent device operably configured be detectable by at least one theft deterrent gate device disposed proximate an entrance area to the retail environment; and an alarm operably configured to communicate an alarm condition in response to the at least one theft deterrent gate device detecting the theft deterrent device.

9. The monitoring system in accordance with claim 8, further comprising:

a wearable anti-tamper device configuring to be worn by the individual and communicatively coupled to the wearable monitoring device, the wearable anti-tamper device including:

a controller having a processor and memory; and program instructions stored in memory and executable by the processor to perform the steps of:

communicating a first anti-tamper ping signal to the wearable monitoring device;

receiving a second anti-tamper ping signal from the wearable monitoring device;

determining whether the second anti-tamper ping signal is received in response to the first anti-tamper ping signal within a predetermined time period; and causing an anti-tamper alarm to communicate a tamper alarm condition in response to determining that the second anti-tamper ping signal was not received within the predetermined time period.

10. The monitoring system in accordance with claim 8, further comprising:

a wearable anti-tamper device configuring to be worn by the individual and communicatively coupled to the wearable monitoring device, the wearable anti-tamper device including:

a controller having a processor and memory, the memory storing a predetermined time period;

at least one antenna communicatively coupled to the controller;

an anti-tamper alarm communicatively coupled to the controller; and program instructions stored in memory and executable by the processor to perform the steps of:

communicating a first anti-tamper ping signal to the wearable monitoring device via the at least one antenna;

receiving a second anti-tamper ping signal from the wearable monitoring device via the at least one antenna;

determining whether the second anti-tamper ping signal is received in response to the first anti-tamper ping signal within the predetermined time period; and causing the anti-tamper alarm to communicate a tamper alarm condition in response to determining that the second anti-tamper ping signal was not received within the predetermined time period.

11. The monitoring system in accordance with claim 8, further comprising:

memory including a plurality of identifications associated with individuals to be deterred from entrance into the retail environment; and a processor communicatively coupled to the at least one theft deterrent gate device disposed proximate the entrance area to the retail environment, the processor operably configured to execute program instructions stored in memory, the program instructions including:

receiving a communication of an identification associated with the individual to be deterred from entrance into the retail environment;

determining whether the identification corresponds to one of the plurality of identifications stored in the memory; and in response to the identification corresponding to one of the plurality of identifications stored in memory, causing an alarm condition.

12. The monitoring system in accordance with claim 11, wherein:

the alarm condition includes at least one of:

generating an audible alarm;

communicating a monitored retail environment entry attempt to a store personnel; and communicating a monitored retail environment entry attempt to an officer.

13. The monitoring system in accordance with claim 8, wherein:

the at least one theft deterrent gate device includes:

a transmitter gate operably configured to transmit a first signal; and a receiver gate operably configured to receive the first signal from the transmitter gate and operably configured to detect a variation of the first signal indicative of the theft deterrent device being within range of the receiver gate, the variation including at least one of:

an interference with the first signal;

a decrease in a strength of the first signal; and a second signal transmitted by the theft deterrent device between periodic, discontinuous pulses of the first signal.

14. The monitoring system in accordance with claim 8, wherein:

the theft deterrent device is formed as at least one of:

a radio frequency tag;

an electromagnetic tag; and an acousto-magnetic tag.

15. The monitoring system in accordance with claim 8, wherein:

the wearable monitoring device includes a wearable body that is formed as at least one of:

an anklet; and a bracelet.

16. A method for deterring and/or monitoring entrance of supervised individuals into an area, the method comprising:

providing a wearable monitoring device associated with an individual to be deterred from entrance into a retail environment, the device including:

a theft deterrent device, the theft deterrent device operably configured to be detectable by at least one theft deterrent gate device disposed proximate an entrance area to the retail environment; and an audible alarm; and in response to the at least one theft deterrent gate device detecting the theft deterrent device, causing the audible alarm to sound.

17. The method in accordance with claim 16, further comprising:

providing a wearable anti-tamper device communicatively coupled to the wearable monitoring device;

the wearable anti-tamper device communicating a first anti-tamper ping signal to the wearable monitoring device;

the wearable monitoring device communicating a second anti-tamper ping signal to the wearable anti-tamper device;

determining a time period between the first anti-tamper ping signal and the second anti-tamper ping signal; and communicating an anti-tamper alarm condition in response to the time period reaching or exceeding a predetermined time period.

18. The method in accordance with claim 16, further comprising:

storing in memory an identification associated with the individual to be deterred from entrance into the retail environment.

19. The method in accordance with claim 16, wherein:

the at least one theft deterrent gate device includes:

a transmitter gate operably configured to transmit a first signal; and a receiver gate operably configured to receive the first signal from the transmitter gate and operably configured to detect a variation of the first signal indicative of the theft deterrent device being within range of the receiver gate, the variation including at least one of:

an interference with the first signal;

a decrease in a strength of the first signal; and a second signal transmitted by the theft deterrent device between periodic, discontinuous pulses of the first signal.

20. The method in accordance with claim 16, wherein:

the theft deterrent device is formed as at least one of:

a radio frequency tag;

an electromagnetic tag; and an acousto-magnetic tag.

21. A wearable electronic monitoring device for deterring and/or monitoring entrance of an individual wearing the device into an area, the device comprising:

a wearable body configured to be worn by an individual to be deterred from entrance into a retail environment;

a theft deterrent device coupled to the wearable body, the theft deterrent device operably configured to be detectable by at least one theft deterrent gate device disposed proximate an entrance area to the retail environment; and a controller coupled to the wearable body, the controller having a processor, a memory, and programming instructions stored in memory and executable by the processor to perform a step of communicating a monitored retail environment entry attempt.

22. The device in accordance with claim 21, further comprising:

an alarm coupled to the wearable body and operably configured to communicate an alarm condition in response to the at least one theft deterrent gate device detecting the theft deterrent device.

* * * * *